US006446725B2

(12) United States Patent
Cabot

(10) Patent No.: US 6,446,725 B2
(45) Date of Patent: Sep. 10, 2002

(54) ROTATING CASING ASSEMBLY AND METHOD

(75) Inventor: Bernard Cabot, Calgary (CA)

(73) Assignee: CGI Downhole Solutions Inc., Calgary (CA)

( * ) Notice: Subject to any disclaimer, the term of this patent is extended or adjusted under 35 U.S.C. 154(b) by 0 days.

(21) Appl. No.: 09/725,163

(22) Filed: Nov. 29, 2000

(30) Foreign Application Priority Data

Nov. 30, 1999 (CA) ..... 2291301

(51) Int. Cl.[7] ..... E21B 33/14; E21B 33/13
(52) U.S. Cl. ..... 166/286; 166/177.4
(58) Field of Search ..... 166/177.4, 285, 166/286, 381

(56) References Cited

U.S. PATENT DOCUMENTS 3,111,171 A 11/1963 Farrar et al.
3,557,875 A 1/1971 Solum et al.
4,678,031 A 7/1987 Blandford et al.
4,787,457 A 11/1988 Webster et al.
4,869,323 A 9/1989 Stagg
4,926,938 A 5/1990 Lindsey, Jr.
5,152,342 A 10/1992 Rankin et al.
5,309,996 A 5/1994 Sutton
6,311,774 B1 * 11/2001 Brockman et al. ..... 166/177.3

FOREIGN PATENT DOCUMENTS

SU 976030 A * 11/1982

* cited by examiner

*Primary Examiner*—David Bagnell
*Assistant Examiner*—Jennifer H Gay
(74) *Attorney, Agent, or Firm*—Bennett Jones LLP

(57) ABSTRACT

The rotating casing assembly and method, as described herein, allows for rotation of the casing at any depth to decrease the chance of microchannelling along the annulus. The assembly includes a casing section mounted through a bearing device to a casing string. The casing section is driven to rotate as permitted by the bearing by the energy of the fluid being pumped through the casing and across vanes in the casing section.

5 Claims, 2 Drawing Sheets

ROTATING CASING ASSEMBLY AND METHOD

FIELD OF THE INVENTION

The present invention is directed to an assembly for rotating wellbore casing during cementing-in of the casing.

BACKGROUND OF THE INVENTION

In the cementing-in of casing, the main problem encountered is how to provide a better cement bond between the casing, the wellbore and the cement in the annulus to overcome the problem of water migration between various zones, sometimes termed microchannelling.

Many processes are used in an attempt to enhance cement bonding. For example, cement squeezes, packer zone isolation, and turbolizers are sometimes used. These methods are expensive and complex and are not always effective.

It is common practice to rotate casing in shallow holes (to approx. 1000 m) in order to enhance wellbore cementing. This has been found to noticeably enhance the bond between the casing and the cement thereby decreasing the chance of microchannelling along the casing string. While rotating has been found to be effective at shallower depths, it is not feasible due to the high torque generated to rotate the casing from surface in deeper holes or in bridged-off portions of the hole.

SUMMARY OF THE INVENTION

An assembly and method have been invented to provide for rotation of a casing section in a zone of interest without requiring rotation of the casing string from surface. Such rotation enhances cementing procedures. The assembly is particularly useful as it permits rotation in zones of interest such as, for example, in deep sections of the borehole where previously casing rotation was difficult. The assembly is also useful for rotating through bridged-off portions of the hole. The casing section is preferably rotated by passing wellbore fluids such as mud or cement past vanes in the casing section of interest.

Thus in accordance with a broad aspect of the present invention, there is provided: an assembly for connection to a casing string comprising: a casing section connected to the casing string through a bearing device, the bearing device permitting rotation of the casing section relative to the casing string and a means for rotating the casing section relative to the casing string.

The means for rotating the casing section can be a plurality of vanes formed on the casing section and positioned to cause rotation of the casing section by action of well fluids moving therepast. The vanes are preferably formed within the casing section. To provide for removal of the vanes should it be desirable to have access therebelow, the vanes can be formed of easily drillable material such as aluminum or fiberglass.

In accordance with a further aspect of the present invention, there is provided a method for cementing in a casing section at a zone of interest, comprising: providing a casing string with a casing section attached thereto and extending across a zone of interest, the casing section and the casing string each having inner bores and the inner bore of the casing section being in communication with the inner bore of the casing string; and pumping cement through the inner bores of the casing string and the casing section while rotating the casing section at an increased rate of rotation than that of the casing string.

In accordance with another aspect of the present invention, there is provided a method for rotating a section of casing a rate different from any rate of rotation of the casing string to which the section of casing is attached; comprising: providing a casing string and a casing section connected to the casing string through a bearing device, the bearing device permitting rotation of the casing section relative to the casing string and a means for rotating the casing section relative to the casing string; and actuating the means for rotating to drive the casing section to rotate on the bearing device relative to the casing string.

BRIEF DESCRIPTION OF THE DRAWINGS

A further, detailed, description of the invention, briefly described above, will follow by reference to the following drawings illustrating one embodiment of the invention. These drawings depict only a typical embodiment of the invention and are therefore not to be considered limiting of its scope. In the drawings.

DETAILED DESCRIPTION OF THE PREFERRED EMBODIMENTS

The rotating casing assembly according to the present invention allows for rotation of the casing at any depth. Only a selected portion of the casing will be rotated and rotation from surface is not required to cause rotation of the selected casing portion. The selected portion that is rotated is usually the portion crossing the production zone. This method is extremely economical compared to other methods and requires no additional rig time or surface equipment. The casing is driven to rotate by the fluid being pumped across the vanes mounted within the selected portion of casing.

Figure 1:
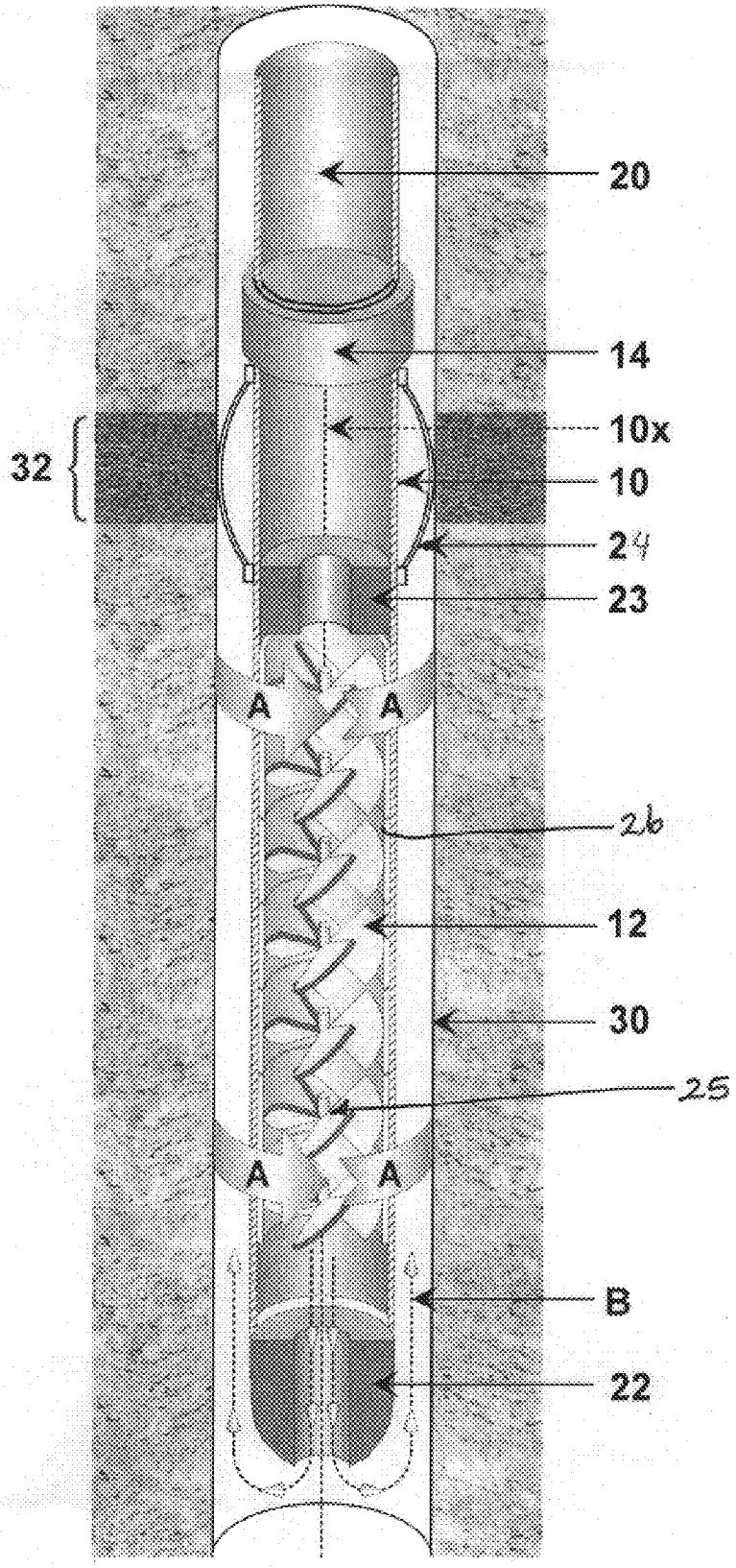
FIG. 1 is a section along a casing string in a wellbore including an assembly according to the present invention.

In one embodiment as shown in FIG. 1, the assembly includes a section of casing 10 with a series of internal vanes 12 and a bearing pack 14. The assembly is connected to a casing string 20. The casing string can include standard components including, for example, a casing shoe 22 at the lower end thereof and a float collar 23 between the vanes and the bearing pack. In the illustrated embodiment, casing shoe 22 is connected directly to the bottom of casing section 10 and float collar 23 is installed directly above vanes 12. However, in other embodiments, standard casing sections can be connected below section 10 and the casing shoe is connected to the standard casing. Bearing pack 14 permits casing section 10 and the string below it, if any, to rotate about its long axis 10× relative to casing string 20 above the casing section.

In some embodiments, a lower bearing pack can be installed below the vanes, such that the casing section between the bearings can rotate relative to the casing strings above and below it. However, in so doing consideration must be given as to avoiding the casing joints below the lower bearing from unthreading.

Bearing pack 14 must be able to carry the weight of casing section 10 and any other components below the casing section. The bearing pack must also be sealed to prevent leakage between the interior of the casing and the annulus about it. This prevents contamination of and damage to the bearing by well fluids including mud and cement. The bearing pack must also be selected to meet or exceed burst pressure, tensile and collapse ratings of the casing with which it is used. As will be appreciated, the minimum inner diameter (ID) of the bearing pack should not be less than the minimum ID of the casing and the outer diameter (OD) of the bearing pack should be selected to be less than the diameter of the well bore. The bearing pack can be for example a race of ball bearings sealed by O-rings within a housing.

The bearing pack can be connected in any desirable way such as, for example, by welding or threaded connection between the end of standard casing string 20 and section of casing 10. All connections must be fluid tight at downhole pressures, as will be appreciated. Casing shoe 22 is connected by welding, rather than threading, to casing section 10 to avoid unthreading of these parts during rotation.

Casing section 10 is formed of one or more joints of casing. In most embodiments, for standard wellbores, casing section 10 is formed of two to ten joints of casing. Casing section 10 must be selected to have fluid tight connections and to meet or exceed the burst pressure of the casing string. Preferably, casing section 10 is formed using casing joints similar or identical to the casing joints used to form the remainder of the casing string. This ensures that the casing used is consistent in outer diameter, length, thread, and pressure rating as the other casing.

Centralizers 24 can be positioned about casing section 10 to ensure appropriate spacing between the casing OD and the wellbore wall. Of course, the centralizer is one which permits rotation of the casing relative to the centralizer and/or wellbore wall.

Figure 2:
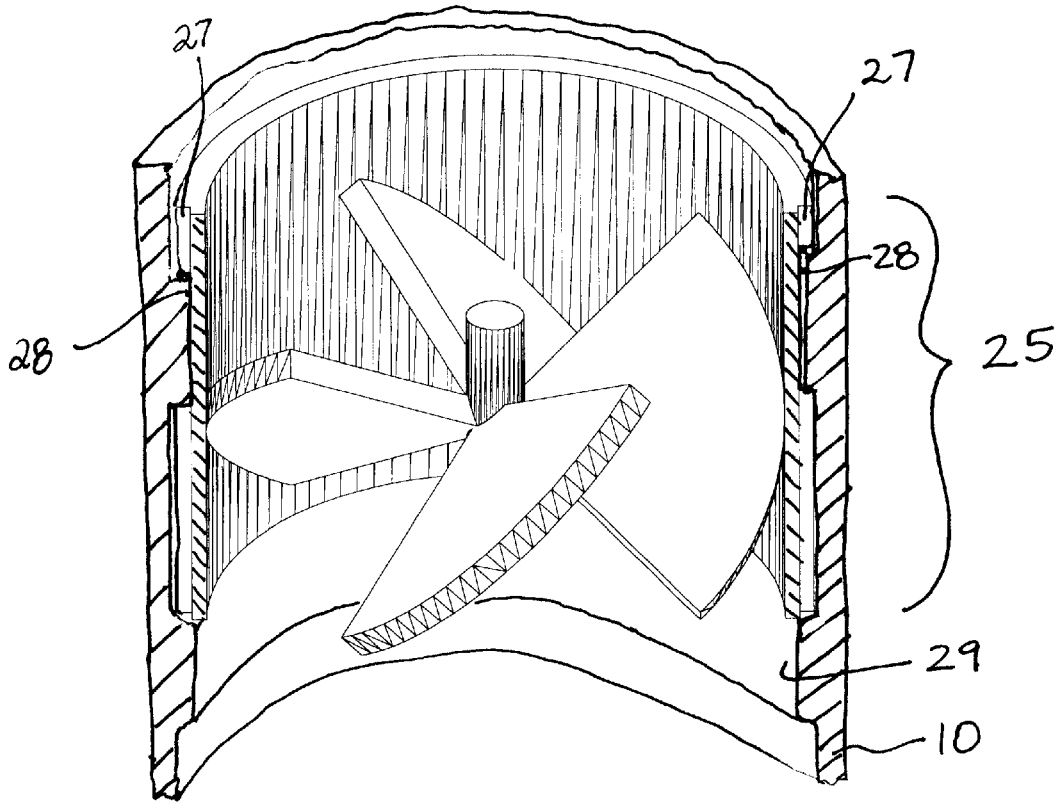
FIG. 2 is a section through a vane stage useful in the present invention. The vane stage is mounted in a liner supported in a section of casing.

Referring also to FIG. 2, internal vanes 12 are shaped and/or positioned to drive the casing to rotate on bearing pack 14 when fluid is pumped past the vanes. To provide drive, vanes 12 can have standard turbine structure and positioning, as would be appreciated. In one embodiment, the vanes are arranged in stages with four vanes in each stage 25.

To facilitate assembly, in a preferred embodiment, the vanes are formed as by milling or molding onto a liner 26. The liner is selected to have an OD just slightly less than the ID of the casing section to that it fits snugly down into the bore of the casing section. The outer surface of liner 26 includes longitudinally extending key ways 27 for accepting keys 28 mounted, as by welding, onto the inner surface of casing section 10. Once liner 26 is mounted in the casing section with keys 28 in key ways 27, the liner cannot rotate within the casing section. Preferably, the liners each accommodate one stage of vanes and have edges formed to permit interlocking with adjacent liners. Thus, any number of liners 26 can be installed in series within casing section. The lowermost liner rests on a raised stop 29, for example a collar or a stop ring, mounted or formed on the inner surface of the casing section.

The vanes are configured to drive rotation of the casing section to the left, as shown by arrows A. Left-hand rotation is used since, should the bearing pack fail, the casing string will not unthread and come apart.

In a preferred embodiment, vanes 12 and liner 26 are formed of a drillable material such as, for example, aluminum or fiberglass to facilitate removal thereof from the casing string.

The rotating casing assembly according to the present invention is used to enhance wellbore cementing. For example, rotating the casing enhances cement flow, enhances removal of annulus debris, and reduces microchanneling. An assembly according to the present invention, as described above, is connected into a casing string 20 and positioned such that when run into the wellbore 30, it extends through the zone of interest 32. In particular, preferably, bearing pack 14 is positioned above zone of interest 32 and casing section 10 is of a sufficient length to extend below the zone of interest. To reduce the necessity for drilling out the vanes, preferably the casing section is positioned with vanes 12 below the zone of interest. Cement, indicated by arrows B, is pumped through the casing string 20 and casing section 10, past float collar 23 and vanes 12 and out through the casing shoe 22. As the cement passes vanes 12, the vane structure drives casing section 10 to rotate as permitted by bearing pack 14. Rotation occurs about long axis 10× of section 10 and below bearing pack 14. Casing string 20 may be stationary or rotating. However, the drive created by vanes 12 is sufficient to cause section 10 to have a rate of rotation different, and generally greater, than any rate of rotation of the casing string above bearing pack 14.

To determine the number of vanes required for rotation of the particular casing section in use, first it is necessary to determine the ft. lbs of torque required to rotate the casing section. This will be determinable from wellbore information. Next, with consideration as to velocity, density and viscosity of the fluid to be used, the torque generated by the fluid passing one vane or one stage of vanes is determined. This information is then used to determine the number of vanes or stages required to achieve or exceed the torque necessary to rotate casing section 10.

Once the cement is introduced, a wiper plug (not shown) is forced through the casing string to land in float collar 23. As in standard cementing operations, the plug displaces cement from the casing string above the float collar.

Once the cement sets, it can be drilled out of the inner bore of casing section, if desired. The vanes 12 and liner 26 can be formed of an easily drillable material such as aluminum or fiberglass to permit removal thereof. Casing section 10 and bearing pack 14 can be left down hole and will not effect well production.

Although the casing section has been described for use in wellbore cementing operations, it is also useful for working pipe through bridged-off sections of the wellbore during run in of casing. Rotation would be achieved by pumping mud through the casing section. A spaded casing shoe is useful in such procedures.

It will be apparent that may other changes may be made to the illustrative embodiments, while falling within the scope of the invention and it is intended that all such changes be covered by the claims appended hereto.

The embodiments of the invention in which an exclusive property privilege is claimed are defined as follows:

1. An assembly for connection to a casing string comprising:

a casing section connected to the casing string through a bearing device, the bearing device permitting rotation of the casing section relative to the casing string and a plurality of vanes formed on the casing section and positioned to cause rotation of the casing section relative to the casing string by action of fluids moving therepast.

2. The assembly as in claim 1 wherein the vanes are positioned within the casing section.

3. The assembly as in claim 2 wherein the vanes are formed of easily drillable material.

4. A method for rotating a section of casing at a rate different from any rate of rotation of the casing string to which the section of casing is attached to rotate through a bridged off portion of the hole, comprising:

providing a casing string and a casing section connected to the casing string through a bearing device, the bearing device permitting rotation of the casing section relative to the casing string and a means for rotating the casing section relative to the casing string; and actuating the means for rotating to drive the casing section to rotate on the bearing device relative to the casing string.

5. A method rotating a section of casing at a rate different from any rate of rotation of the casing string to which the section of casing is attached to create turbulence in cement passing through a casing annulus during a wellbore cementing operation, the method comprising:

providing a casing string and a casing section connected to the casing string through a bearing device, the bearing device permitting rotation of the casing section relative to the casing string and a means for rotating the casing section relative to the casing string; and actuating the means for rotating to drive the casing section to rotate on the bearing device relative to the casing string.

* * * * *